US005797302A

United States Patent [19]

Khoury

[11] Patent Number: 5,797,302

[45] Date of Patent: Aug. 25, 1998

[54] SCREWDRIVER ADAPTED TO BE COUPLED TO AN ELECTRIC DRILL FOR AUTOMATIC ROTATION THEREOF

[76] Inventor: Joseph F. Khoury, 3383 West 150, Cleveland, Ohio 44111

[21] Appl. No.: 754,940

[22] Filed: Nov. 25, 1996

[51] Int. Cl.[6] ..... B25B 23/08

[52] U.S. Cl. ..... 81/454; 81/451; 81/436

[58] Field of Search ..... 81/436, 438, 451, 81/454, 455

[56] References Cited

U.S. PATENT DOCUMENTS

| | | | |
|---|---|---|---|
| 1,501,222 | 7/1924 | Lamp | 81/439 |
| 1,688,525 | 10/1928 | Cowart | 81/436 |
| 2,698,637 | 1/1955 | Donovan | 81/451 |
| 2,726,091 | 12/1955 | Topar | 81/436 |
| 2,829,658 | 4/1958 | Mitchell et al. | 81/451 |
| 2,923,335 | 2/1960 | Joyce | 81/438 |
| 3,289,290 | 12/1966 | Sandor | 81/436 |
| 3,484,114 | 12/1969 | Rodin | 81/436 |
| 3,556,184 | 1/1971 | Wagner | 81/451 |
| 4,437,365 | 3/1984 | Yaari | 81/436 |
| 5,343,786 | 9/1994 | Wridt | 81/438 |

*Primary Examiner*—D. S. Meislin
*Assistant Examiner*—Joni B. Danganan

[57] ABSTRACT

A screwdriver adapted to be coupled to an electric drill for automatic rotation thereof including an interior member having a lower extent with a circular cross-section and a screwdriver tip at its end. The interior member has an upper extent of an enlarged cylindrical shape with a hexagonal component extending rearwardly thereof. An exterior cylindrical member of the screwdriver has a lower extent of a reduced diameter and an upper extent of an enlarged diameter and has an interior bore extending therethrough. The bore of the upper extent is adapted to receive the upper extent of the interior member and the lower extent of the exterior cylindrical member is adapted to receive the lower extent of the interior member with the screwdriver tip extending through the lower end thereof.

1 Claim, 2 Drawing Sheets

FIG 3
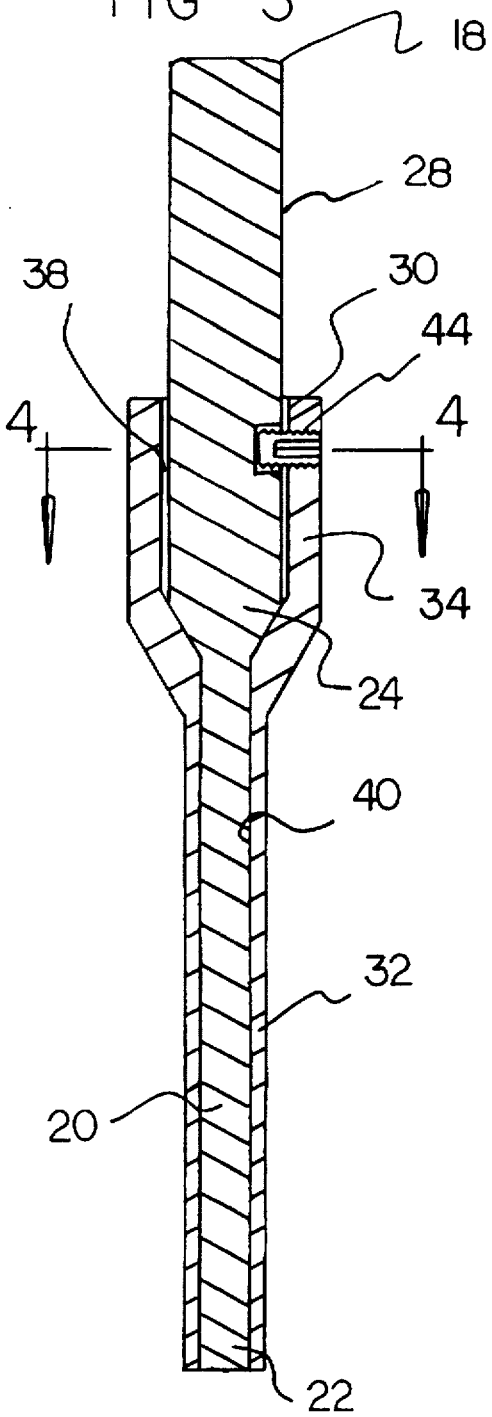
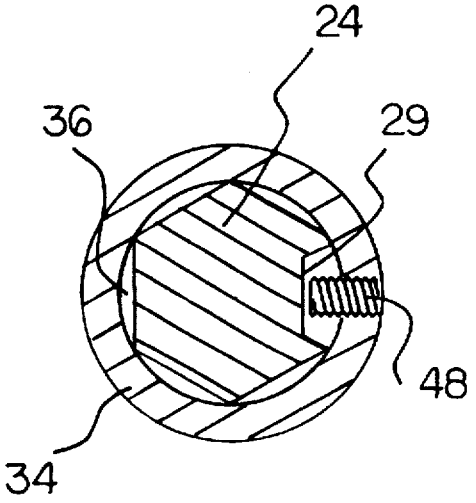
FIG 4

SCREWDRIVER ADAPTED TO BE COUPLED TO AN ELECTRIC DRILL FOR AUTOMATIC ROTATION THEREOF

BACKGROUND OF THE INVENTION

1. Field of the Invention

The present invention relates to a screwdriver adapted to be coupled to an electric drill for automatic rotation thereof and more particularly pertains to facilitating the use of screwdrivers by the application of an electrical drill for providing the rotational forces.

2. Description of the Prior Art

The use of screwdrivers, power drills and a large number of tools of a wide variety of designs and configurations is known in the prior art. More specifically, screwdrivers, power drills and a large number of tools of a wide variety of designs and configurations heretofore devised and utilized for the purpose of facilitating tasks requiring the use of tools through a large number of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,498,351 a screwdriver with screw-gripping jaws.

U.S. Pat. No. 3,900,057 discloses an expandable bit screw holding screwdriver.

U.S. Pat. No. 4,078,593 discloses a slide mechanism for expandable bit screw holding screwdriver.

U.S. Pat. No. 4,779,494 discloses a screwdriver having a screw gripping feature.

U.S. Pat. No. 5,056,387 discloses a screw-holding screwdriver.

In this respect, the screwdriver adapted to be coupled to an electric drill for automatic rotation thereof according to the present invention substantially departs from the conventional concepts and designs of the prior art, and in doing so provides an apparatus primarily developed for the purpose of facilitating the use of screwdrivers by the application of an electrical drill for providing the rotational forces.

Therefore, it can be appreciated that there exists a continuing need for a new and improved screwdriver adapted to be coupled to an electric drill for automatic rotation thereof which can be used to facilitate the use of screwdrivers by the application of an electrical drill for providing the rotational forces. In this regard, the present invention substantially fulfills this need.

SUMMARY OF THE INVENTION

In view of the foregoing disadvantages inherent in the known types of screwdrivers, power drills and a large number of tools of a wide variety of designs and configurations now present in the prior art, the present invention provides an improved screwdriver adapted to be coupled to an electric drill for automatic rotation thereof. As such, the general purpose of the present invention, which will be described subsequently in greater detail, is to provide a new and improved screwdriver adapted to be coupled to an electric drill for automatic rotation thereof and method which has all the advantages of the prior art and none of the disadvantages.

To attain this, the present invention essentially comprises a new and improved screwdriver adapted to be coupled to an electric drill for automatic rotation thereof comprising an interior member having a lower extent with a circular cross-section and a screwdriver tip at its end. The interior member has an upper extent of an enlarged cylindrical shape with a hexagonal component extending rearwardly thereof adapted to be supported and rotated by an electric drill. The upper extent has a recess extending thereinto. The device includes an exterior cylindrical member having a lower extent of a reduced diameter and an upper extent of an enlarged diameter and having an interior bore extending therethrough. The bore of the upper extent is adapted to receive the upper extent of the interior member and the lower extent of the exterior cylindrical member is adapted to receive the lower extent of the interior member with the screwdriver tip extending through the lower end thereof. The upper extent of the exterior cylindrical member has a threaded aperture extending therethrough. The threaded aperture aligns with the recess of the interior member when the interior member is received within the exterior cylindrical member. A threaded screw extends between the threaded aperture and the recess for securement of the interior member within the exterior cylindrical member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved screwdriver adapted to be coupled to an electric drill for automatic rotation thereof which has all the advantages of the prior art screwdrivers, power drills and a large number of tools of a wide variety of designs and configurations and none of the disadvantages.

It is another object of the present invention to provide a new and improved screwdriver adapted to be coupled to an electric drill for automatic rotation thereof which may be easily and efficiently manufactured and marketed.

It is a further object of the present invention to provide a new and improved screwdriver adapted to be coupled to an electric drill for automatic rotation thereof which is of durable and reliable constructions.

An even further object of the present invention is to provide a new and improved screwdriver adapted to be coupled to an electric drill for automatic rotation thereof which is susceptible of a low cost of manufacture with regard to both materials and labor, and which accordingly is then susceptible of low prices of sale to the consuming public, thereby making such screwdriver adapted to be coupled to an electric drill for automatic rotation thereof economically available to the buying public.

Still yet another object of the present invention is to provide a new and improved screwdriver adapted to be coupled to an electric drill for automatic rotation thereof which provides in the apparatuses and methods of the prior art some of the advantages thereof, while simultaneously overcoming some of the disadvantages normally associated therewith.

Still another object of the present invention is to facilitate the use of screwdrivers by the application of an electrical drill for providing the rotational forces.

Lastly, it is an object of the present invention to provide a new and improved screwdriver adapted to be coupled to an electric drill for automatic rotation thereof including an interior member having a lower extent with a circular cross-section and a screwdriver tip at its end. The interior member has an upper extent of an enlarged cylindrical shape with a hexagonal component extending rearwardly thereof. An exterior cylindrical member of the screwdriver has a lower extent of a reduced diameter and an upper extent of an enlarged diameter and has an interior bore extending therethrough. The bore of the upper extent is adapted to receive the upper extent of the interior member and the lower extent of the exterior cylindrical member is adapted to receive the lower extent of the interior member with the screwdriver tip extending through the lower end thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front cross-sectional view of the device of the prior Figure.

FIG. 4 is a cross-sectional view as taken along line 4—4 of FIG. 3.

The same reference numerals refer to the same parts through the various Figures.

DESCRIPTION OF THE PREFERRED EMBODIMENT

Figure 1:
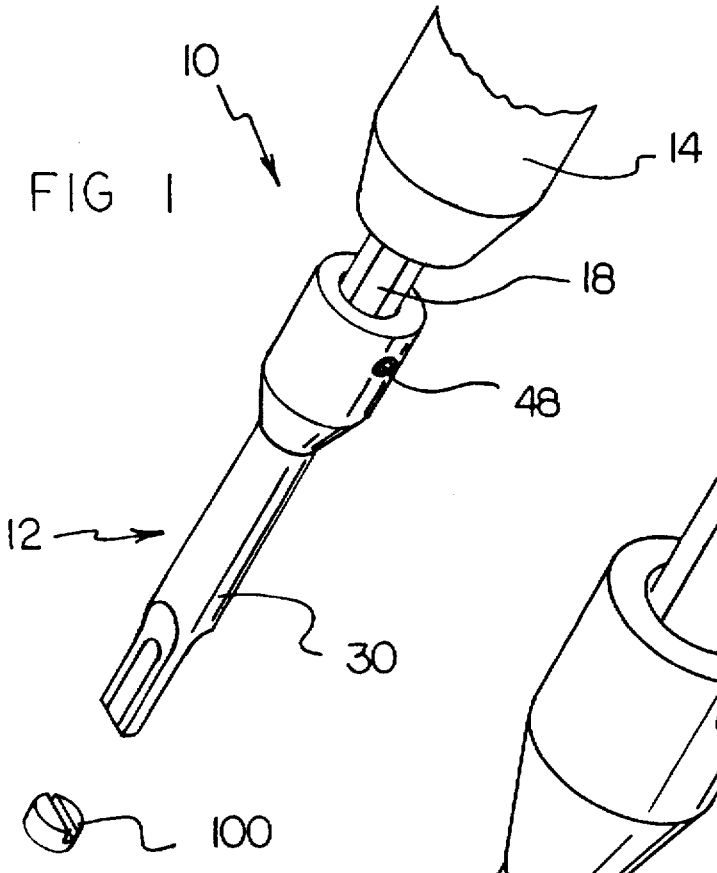
FIG. 1 is a perspective view of the preferred embodiment of the new and improved screwdriver adapted to be coupled to an electric drill for automatic rotation thereof constructed in accordance with the principles of the present invention.
Figure 2:
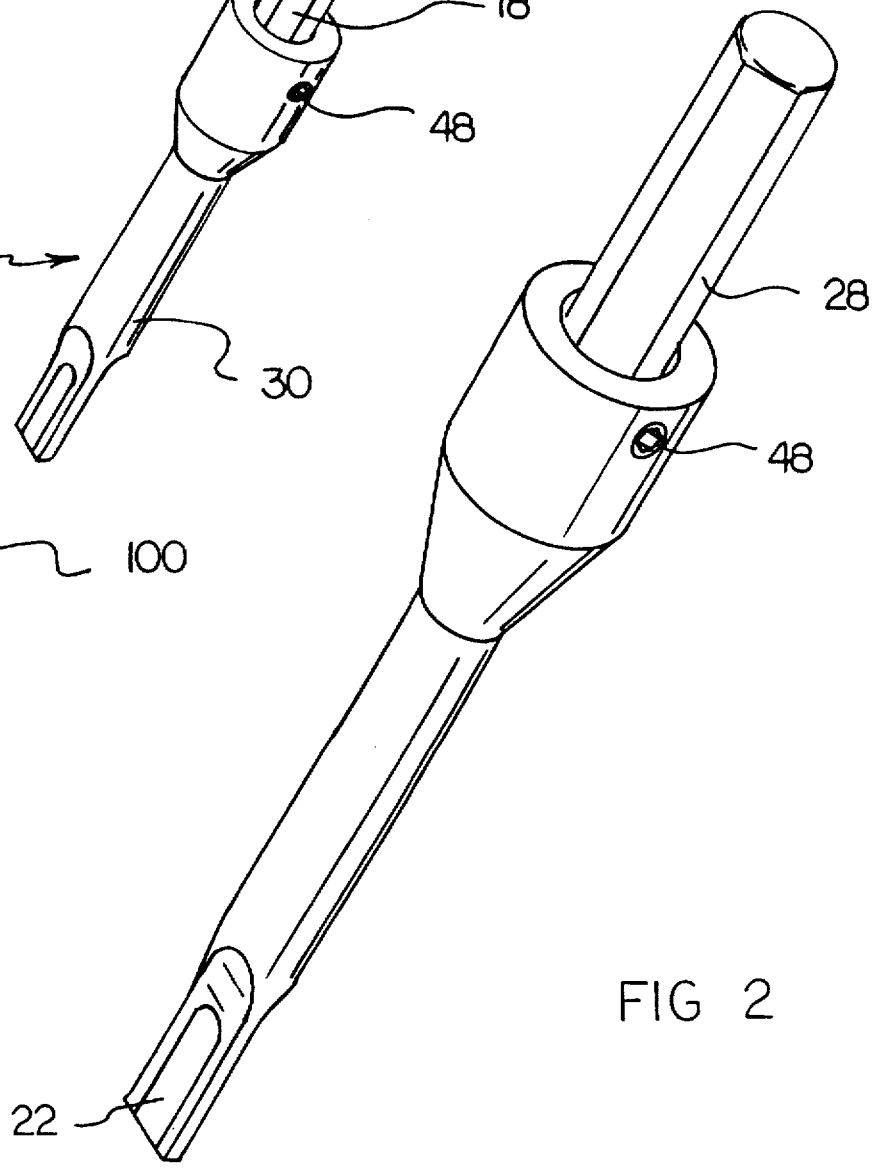
FIG. 2 is an elevated perspective view of the device shown in FIG. 1.

With reference now to the drawings, and in particular to FIG. 1 through 4 thereof, the preferred embodiment of the new and improved screwdriver adapted to be coupled to an electric drill for automatic rotation thereof embodying the principles and concepts of the present invention and generally designated by the reference numeral 10 will be described.

The present invention, the new and improved screwdriver adapted to be coupled to an electric drill for automatic rotation thereof, is a system 10 comprised of a plurality of components. Such components, in their broadest context, include an interior member, an exterior cylindrical member and a threaded screw. Such components are individually configured and correlated with respect to each other so as to attain the desired objective.

The present invention is a system 10 including a screw driver 12 adapted to be coupled to an electrical drill 14 for the automatic rotation thereof. The central component of the system 10 is an interior member 18. Such interior member has a lower extent 20. The cross-section thereof is circular. The lower extent also includes a screw driver tip 22 at its lower end. The interior member also has an upper extent 24. The upper extent is of an enlarged cylindrical shape in cross-sectional. It has a hexagonal component 28 extending rearwardly thereof. Such hexagonal component is adapted to be supported and rotated by an electrical drill during operation and use. The upper extent also has a recess 29 extending thereinto.

The next component of the system 10 is an exterior cylindrical member 30. The exterior cylindrical member has a lower extent 32 of a reduced diameter. It also has an upper extent 34 of an enlarged diameter. The exterior cylindrical member is provided with a central interior bore 36. Such bore 36 extends through the entire exterior cylindrical member 30. The bore 36 has an upper extent 38 adapted to receive the upper extent 24 of the interior member 18. The exterior cylindrical member 30 has in its bore 36 a lower extent 40. The lower extent 40 is adapted to receive the lower extent 20 of the interior member 18. When so received, the screwdriver tip 22 extends through a lower end of the exterior cylindrical member 30. In such orientation, the tip 22 is adapted to contact and rotate the head of a screw 100. The upper extent 34 of the exterior cylindrical member 30 has a threaded aperture 44 extending therethrough. The threaded aperture 44 aligns with the recess 29 of the interior cylindrical member 18 when the interior member 18 is received within the exterior cylindrical member 30.

Next provided in the system is a threaded screw 48. The threaded screw 48 extends between the threaded aperture 44 and the recess 29 for securement of the interior member 18 within the exterior cylindrical member 30.

The present invention is a drill accessory that holds screws to prevent them from coming off the driver and uses power to tighten them.

The unit is cylindrical and resembles a drill bit. It consists of an interior member 18 (¼ inches in diameter), and an exterior cylindrical member 30. All components are made from steel. One end of the interior member 18 is shaped like an ordinary screwdriver blade, while the other end is shaped like the shaft portion of a drill bit. When assembled, the device is about 2½ inches long. A version of the device can also be made for use with phillips head screws.

The present invention is used wherein the device is placed in an ordinary power drill where the drill bit is normally inserted. While holding onto the exterior cylindrical member 30, the driver is placed into the screw head. When the drill is in operation, the interior member 18 will rotate. This creates a locking effect between the screw head and the exterior cylindrical member 30 which holds the screw head in place during rotation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A screwdriver adapted to be coupled to an electric drill for automatic rotation thereof comprising, in combination:

an interior member having a lower extent with a circular cross-section and a screwdriver tip at its end, the interior member having an upper extent of an enlarged cylindrical shape with a Hexagonal component adapted to be supported and rotated by an electric drill, the upper extent having a recess extending thereinto;

an exterior cylindrical member having a lower extent of a reduced diameter and an upper extent of an enlarged diameter and having an interior bore extending through an entire extent thereof, the bore of the upper extent adapted to receive the upper extent of the interior member and the lower extent of the exterior cylindrical member adapted to receive the lower extent of the interior member with the screwdriver tip extending into the lower extent thereof for contacting and rotating a head of a screw, the upper extent of the exterior cylindrical member having a threaded aperture extending therethrough, the threaded aperture aligning with the recess of the interior member when the interior member is received within the exterior cylindrical member;

a threaded screw extending between the threaded aperture and the recess for securement of the interior member within the exterior cylindrical member, the recess having a radial width which is larger than a diameter of the screw for allowing only partial rotation of the interior member within the exterior cylindrical member in coaxial relationship therewith and further precluding sliding of interior member within the exterior cylindrical member alone an axis associated therewith;

whereby the screwdriver tip is engaged with the head of the screw and one of the extents of the exterior cylindrical member is hand held thereby creating a locking effect between the screw, interior member and the exterior cylindrical member which holds the screw in place during rotation of the same by the drill.

* * * * *